US006105329A

United States Patent [19]

Bondoc et al.

[11] Patent Number: 6,105,329

[45] Date of Patent: Aug. 22, 2000

[54] TRILAMINATE ROOFING SHINGLE

[75] Inventors: Alfredo A. Bondoc, Somerset; William R. Carroll, Sussex; Frederick W. Sieling, Bound Brook, all of N.J.

[73] Assignee: Building Materials Corporation of America, Wayne, N.J.

[21] Appl. No.: 09/172,831

[22] Filed: Oct. 15, 1998

[51] Int. Cl.[7] ..... E04D 1/26

[52] U.S. Cl. ..... 52/557; 52/314; 52/554; 52/555; 52/540; 428/143

[58] Field of Search ..... 52/311.1, 311.2, 52/314, 518, 557, 558, 559, 540, 553, 554, 555; 428/143

[56] References Cited

U.S. PATENT DOCUMENTS

| | | | |
|---|---|---|---|
| 1,771,990 | 8/1930 | Bergner | 52/557 |
| 2,064,473 | 12/1936 | Holdsworth | 52/557 X |
| 2,139,820 | 12/1938 | Graham | 52/557 |
| 3,921,358 | 11/1975 | Bettoli | 52/314 |
| 5,181,361 | 1/1993 | Hannah et al. | 52/554 X |
| 5,369,929 | 12/1994 | Weaver et al. | 52/557 |
| 5,426,902 | 6/1995 | Stahl et al. | 52/314 |
| 5,666,776 | 9/1997 | Weaver et al. | 52/557 |
| 6,014,847 | 1/2000 | Phillips | 52/311.1 |
| 6,038,826 | 2/2000 | Stahl et al. | 52/554 |
| 6,038,827 | 2/2000 | Sieling | 52/557 |

*Primary Examiner*—Richard Chilcot
*Attorney, Agent, or Firm*—Marilyn J. Maue; William J. Davis; Walter Katz

[57] ABSTRACT

A trilaminated roofing shingle comprising:

(a) an anterior layer consisting essentially of a rectangular, granular surfaced shingle sheet having an undivided headlap portion and a butt portion comprising a plurality of tabs of an average given breadth separated by spaces approximately 0.50 to 1.25 the breadth of a tab;

(b) a middle layer consisting essentially of a longitudinally coextensive rectangular, granular surfaced shingle sheet of an overall width up to equal the width of the anterior layer, having the same number of tabs of complementary configuration and height as those of (a) and of a breadth which partially fills the spaces between the tabs of (a), so as to provide spaces between tabs of (a) and (b) when assembled, said middle layer being attached to the under surface of said anterior layer in a manner such that the tabs of (b) are centered in and partially fill the spaces between the tabs of (a) and (c) a posterior layer of an undivided, longitudinally coextensive rectangular strip exposable through and filling the spaces between said tabs of (a) and (b) and having granules on its surface in at least its exposed areas, said strip having a width greater than the height of the tabs of (b) and being attached to the under surface of (b).

28 Claims, 3 Drawing Sheets

TRILAMINATE ROOFING SHINGLE

FIELD OF THE INVENTION

In one aspect this invention relates to a roofing shingle having the bulk and configuration of natural shake and slate shingles with excellent fire resistance and protection against weathering while retaining the substantially reduced cost of conventional asphalt shingles over shakes and slate roof coverings.

In another aspect the invention relates to multicolored shingles simulating the shades and colors of natural materials heretofore unachieved to provide an improved aesthetic appearance.

BACKGROUND OF THE INVENTION

This invention pertains to a three layer composite, asphalt impregnated shingle having superior weather resistance and an aesthetic appearance which closely simulates more expensive roofing.

Roofing shingles comprising felt or fabric stock impregnated with asphalt and covered with weather resistant mineral granules are well known. Heretofore they have served as relatively inexpensive alternatives to tile, slate and wood roofing shingles. Although asphalt shingles are fire-resistant, provide good weather protection and are renownedly durable, their substantially planar appearance has made them less pleasing to the eye and less imposing than their more expensive counterparts.

Prior asphalt shingles having areas of different colors have not been successfully commercialized since their unnatural horizontal stripes and indefinable demarcations between the colors create an artificial appearance. Further their horizontal transitional area between colors is contrary to the shadings of natural wood and slate. Thus they do not present the subtle variegation of colors which is associated with abutting natural shingles.

Due to the uncontrolled mixtures of granule sizes in existing asphalt shingles, variation in surface texture exist and unsightly "off color" areas, which are caused by differences in the light reflective characteristics of granules of different sizes imbedded in the shingle, are unpleasantly noticeable.

Accordingly, asphalt shingles heretofore available are at a competitive disadvantage with the more expensive roofing shingles because they lack bulky edge profile, surface contour and color blends which are characteristic of slate and wood shingles. Finally, the installation of conventional composite shingles is tedious and time consuming because such shingles are applied in a regular pattern which requires precise alignment of adjacent courses so as to avoid a haphazard wavy appearance.

Many futile attempts have been made in the prior art to provide asphalt shingles which would achieve the substantial structural and architectural appearance as well as chromic affects characteristic of wood or slate roofing shingles. For example, the prior art suggests that an asphalt shingle may be endowed with a massive ornamental effect by securing an additional riser member beneath the spaced tabs of a conventional shingle. However, the resulting structure, although massive, provides a bumpy butt edge profile and an unattractive surface contour. It has also been proposed that an asphalt shingle be constructed with a plurality of tongues, the upper ends of which are free and the lower ends of which are integral with the body of the shingle. A strip is placed behind the body of the shingle but in front of the tongues which have been fastened to the deck. Such structure provides only a single thickness, uniform butt edge profile and regular, insignificant discontinuities in the surface contour.

Manufacturers of asphalt shingles have long recognized the above problems and have sought to improve the appearance of asphalt shingles by various means including the use of many colors and variations in the configuration or elevation of the tabs. Attempts have also been made to produce irregular surface contours which would give the shingle a bulkier appearance but these efforts have not been commercially rewarded. The goal of producing an inexpensive asphalt shingle which has the physical appearance of more expensive wood and slate shingles has eluded those skilled in the art.

Accordingly, it is an object of this invention to overcome the disadvantages outlined above for asphalt roofing shingles.

Another object is to provide a relatively inexpensive roofing shingle which more closely simulates wood shake or slate shingles by a commercially feasible process.

Another object is to provide roofing which is both aesthetically pleasing and resistant to weathering.

Yet another object is to provide a shingle which facilitates installation on a roof.

These and other objects of the invention will become apparent from the following description and disclosure.

DEFINITIONS

For the purposes of this invention, the term breadth refers to the horizontal dimension of a tab; height refers to the length of the tab extending from the bottom boundary of the headlap to its bottommost edge; length indicates the overall horizontal dimension of a shingle sheet or shingle unit and width indicates the overall vertical dimension of a strip, shingle sheet or shingle unit. The complementary configuration of tabs in sheet (b) indicates that they are preferably of the reverse outline or mirror images of the tabs in sheet (a); alternatively the tabs of (b) may be broader or narrower, higher or shorter, than the tabs of (a) provided that they are narrower than the spaces between tabs (a).

THE INVENTION

In accordance with this invention there is provided an asphalt impregnated, trilaminated, composite roofing shingle comprising:

(a) an anterior layer consisting essentially of a rectangular, granular surfaced shingle sheet having an undivided headlap portion and a butt portion comprising a plurality of tabs of an given average breadth separated by spaces approximately 0.50 to 1.25 the breadth of a tab;

(b) a middle layer consisting essentially of a longitudinally coextensive rectangular, granular surfaced shingle sheet of an overall width up to equal the width of the anterior layer, having the same number of tabs of complementary configuration and height as those of (a) and of a breadth which partially fills the spaces between the tabs of (a), said middle layer being attached to the under surface of said anterior layer in a manner such that the tabs of (b) are centered in and partially fill the spaces between the tabs of (a) and (c) a posterior layer of an undivided, longitudinally coextensive rectangular strip exposable through and filling spaces between said tabs of (a) and (b) and having granules on its surface in at least its exposed areas, said strip having a width greater than the height of the tabs of (b) and being attached to the under surface of (b).

In the present shingle each of the layers (a) and (b) and (c) can be composed of one or more plies of asphalt impregnated sheeting, preferably not more than 3 plies, one of which can be an insulation or polymeric sheet material.

The bottom tab edges of (a), and correspondingly those of (b), can be of any shape or design including serrated, notched, curved, straight line having right angles, curved or crimped corners or a combination of such configurations. The spacing of tabs in each of sheets (a) and (b) can be between about 3 to 12 inches depending on the option of the consumer, the size and height of the roof and other considerations.

Generally, the shingle unit contains 4 to 18 tabs, i.e. 2 to 9 tabs in the anterior butt portion of (a) and an equal number in the butt portion of middle layer (b). The size and shape of the tabs in anterior layer (a) are preferably uniform; although, for certain affects, irregular tabs may be included. For example, one or more of the (a) tabs can be broader and/or longer than others; which shapes and sizes are mirrored in the tabs of middle layer (b).

Optionally the bottom edge of headlap (a) can be modified to include orientation means as a guide to facilitate placement of successive courses of shingles in overlapping offset arrangement. This option aids in accurate, time saving installation for the roofer. The orientation means can be in the form of a mark, slot, slit, indentation or tab located at the surface midsection of the bottom headlap margin of (a) or preferably, for assured alignment, at the midpoint of each space between the tabs of layer (a) on the surface of the bottom headlap margin.

Layer (c) is a substantially undivided rectangular strip longitudinally coextensive with the headlap portion of (a) and underlies the butt portion of middle layer (b). Layer (c) has a width of at least 0.5 inch greater than the butt portion of (b) and, for added bulk, may be so wide as to extend to the full width of layer (a). In the later arrangement, the roof covering at all points of course installation carries a 5 layer covering which is advantageous for heat insulation and in areas subject to high wind velocity. However, under normal conditions, a savings in materials and shingle weight is achieved by limiting the width of the posterior layer to not more than half the width of layer (b) plus a suitable margin for lamination to the lower headlap portion of layer (b). Although posterior layer (c) can be a continuous, straight edged strip filling the spaces between the tabs and mounted so that its lower marginal edge is flush with the lowermost tab edges, it may also be positioned to extend below the tabs for a simulated irregular contour and/or shadow effect which is particularly attractive when strip (c) is extended below the tabs by a margin equal to the spaces, thus providing a uniform border around each tab. Alternatively, the bottom marginal edge of strip (c) can carry indentations which correspond in outline and follow the contour of the tab end corners. This feature is particularly desirable when the corner or corners of the tab or tabs are crimped or curved and strip (c) extends below the tabs.

At least the exposed portions of all surfaces (a), (b) and (c) carry weather resistant, fire retardant mineral granules of the type conventionally employed for these purposes and which are available in a large variety of colors and in different size grades. Although the granules on the tab surface of each layer can be of one uniform color or can comprise a blending of colors and all layers can be similarly colored, a particularly attractive appearance is achieved when distinguishable or contrasting colors, or contrasting mixtures of colors, are employed for the tabs of each of layers (a) and (b) and optionally layer (c). Contrasting color layers or contrasting mixed colors in each layer, or at least the tabs of each layer, can be used to simulate the colors, tones, shadings and blendings of expensive natural wood shake and slate shingles. Shades of white to black as well as brown, red, green, gray, yellow and burnt orange shades and colors can be blended to achieve a desired affect. When layers of contrasting colors are employed, they may be varied progressively from lighter to darker or from darker to lighter tones or colors in the tabs of the layers (a) through (c). More specifically, the color or shade of tabs (a) can be in contrast with that of tabs (b); the color or shade of tabs (a) can be in contrast with layer (c); the color or shade of (c) can be in contrast with the tabs of (b) or each layer can have an individual color keyed to create the illusion of depth. The present trilaminated shingle overcomes many of the difficulties and problems associated with prior multicolored shingles such as the artificial horizontal color stripes or indefinable demarcations between color boundaries which give a tawdry, printed appearance. In the present invention the layers of distinguishable or contrasting color or blends of mixed colors in the tabs of layers (a), (b) and/or strip (c) duplicate the appearance of individual shake or slate shingles which normally vary in blends of color or tones unit to unit.

Having generally described the invention, reference is now had to the drawings which illustrate various and preferred embodiments but which are not to be construed as limiting to the scope of the invention as more broadly defined above and in the appended claims.

DESCRIPTION OF THE DRAWINGS

FIGS. I through VIII are top plan views of various shingle embodiments within the scope of this invention wherein FIG. I illustrates detached layer (a);

FIG. II shows detached layer (b);

Figure 2:
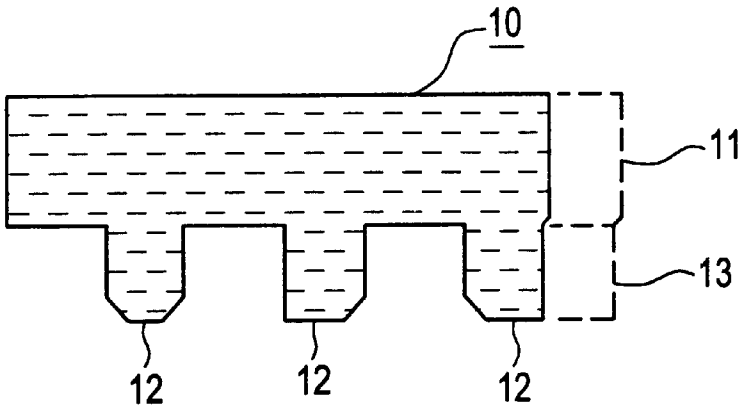
Figure 4:
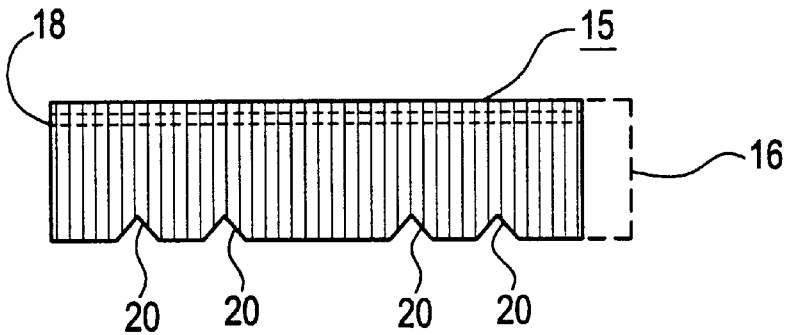
Figure 1:
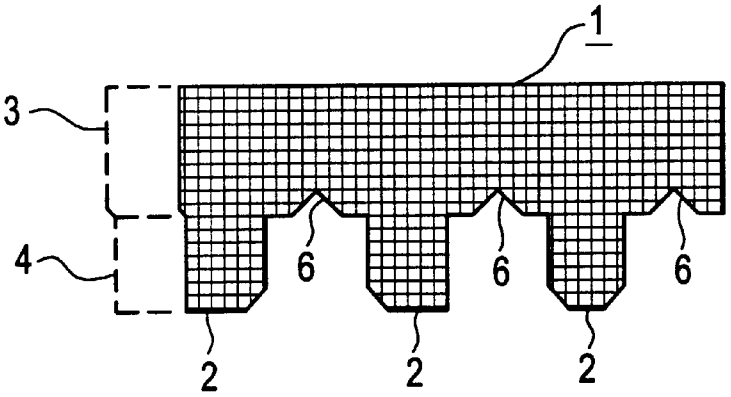
Figure 3:
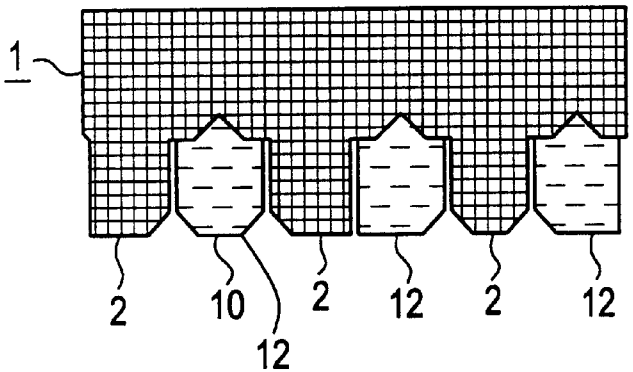
Figure 5:
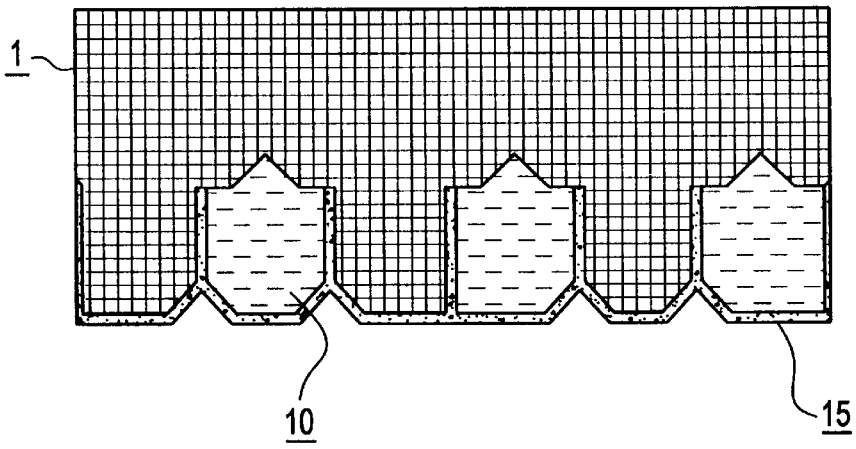
Figure 6:
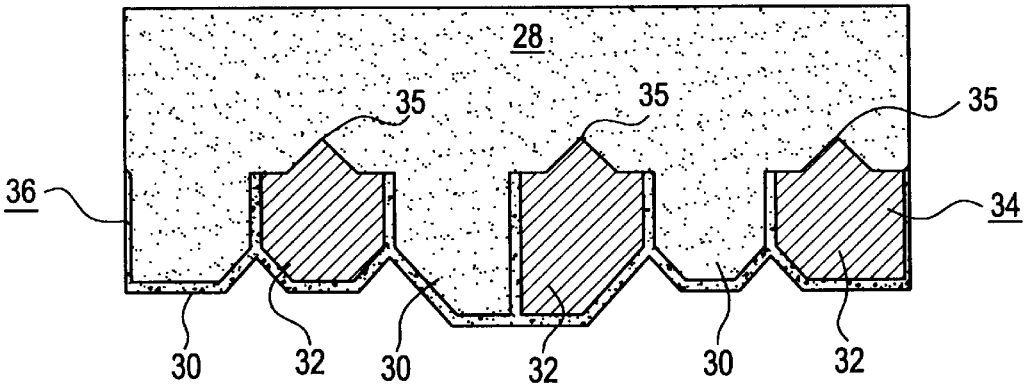
Figure 7:
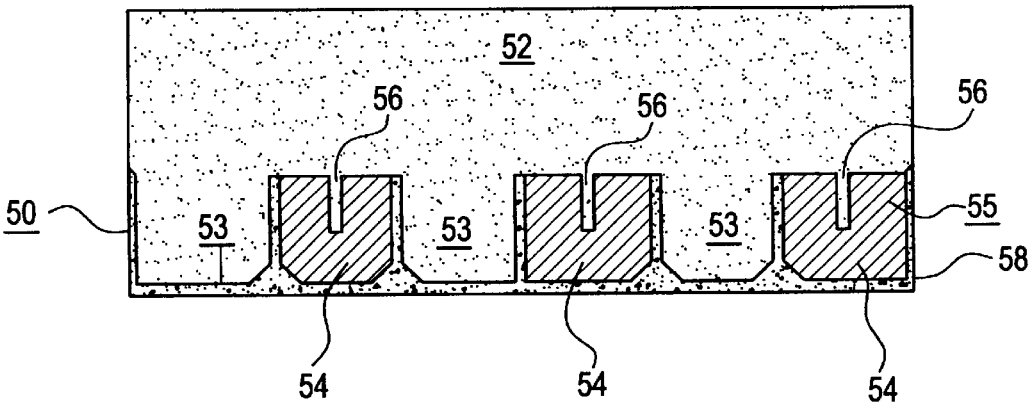
Figure 8:
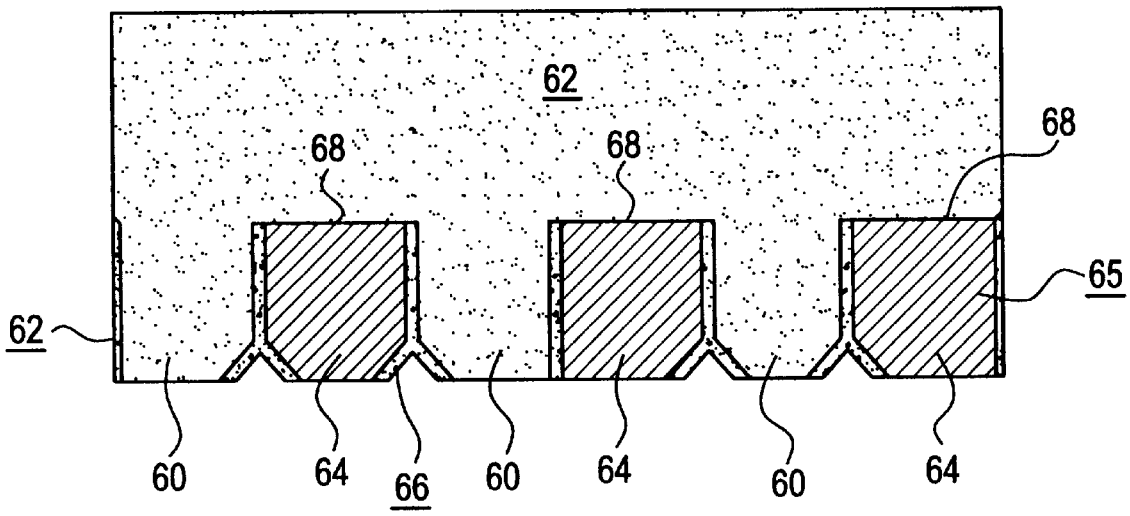
Figure 9:
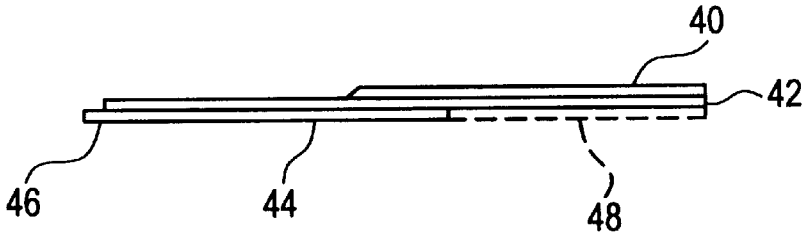

FIG. III shows layer (a) laminated to layer (b);

FIG. IV shows detached layer (c) and

FIG. V illustrates the assembled shingle unit containing layers (a), (b) and (c) of FIGS. I, II and IV.

FIG. VI illustrates a second embodiment of the present shingle unit which is composed of layers similar to those of FIGS. I, II and III except for the varied height of the tabs.

FIG. VII illustrates a third embodiment of the shingle unit which is composed of layers similar to those of FIGS. I, II and III except for the breadth of the tabs.

FIG. VIII illustrates a fourth embodiment having tabs of equal breadth and height and FIG. IX is a cross sectional view of all of the shingle units illustrated above.

The different shadings of the individual layers in the drawings are not intended to signify a particular color value or intensity but only to indicate color contrasts between the layers and each individual layer may be lighter or darker than the shadings indicate, providing that a color contrast between the layers is maintained. For the purposes of this invention it will be understood that the trilaminated shingles herein described also include those wherein all three layers are of the same color or blends of color or wherein only two distinct colors, color blends or shades of color are employed, for example, as when layers (a) and (c); (a) and (b) or (b) and (c) are similar.

DETAILED DESCRIPTION OF THE DRAWINGS

FIG. I illustrates rectangular anterior layer 1 of the present shingle wherein tabs 2, in butt portion 4, depend from headlap portion 3 and orientation means 6 is located at the midpoint of the spaces between each of tabs 2 at the bottom marginal edge of headlap 3. The tabs in this embodiment have crimped and right angled bottom corners and anterior layer 1 has a given color value.

FIG. II illustrates rectangular middle layer 10 having headlap 11 longitudinally and vertically coextensive with 3 in FIG. I and tabs 12 which are shaped as mirror images of tabs 2 in FIG. I but which are slightly narrower in breadth so that they do not completely fill the spaces between tabs 2 when subsequently attached to the under surface of anterior layer 1 as shown in FIG. III. Middle layer 10 has a color value which contrasts with that of anterior layer 1 and orientation marks at the bottom margin of the headlap are absent in layer 10.

FIG. IV shows undivided rectangular posterior layer 15 which is longitudinally coextensive with headlap 3 of anterior layer 1. The width of layer 15 is greater than the butt portions of layers 1 and 10 to allow lamination of top margin 18 to the undersurface of headlap 11 and also to allow for extension of layer 15 below tabs 2 and 12 of layers 1 and 10 when assembled in the composite trilaminated shingle unit as shown in FIG. V. Also as shown, the bottom margin of layer 15 carries indentations 20 which conform in outline to the crimped tab corners of tabs 2 and 12 and layer 15 extends below tabs 2 and 12 by a margin equal to the slot spaces between tabs 2 and tabs 12 to form a uniform border around each tab of the shingle. Each of the layers 1, 10 and 15 has a distinguishable color value which contrasts with the others so that, when assembled as the composite trilaminated shingle unit shown in FIG. V, three discernible color values are clearly visible.

FIG. VI represents a second embodiment of the present composite shingle in an assembled state wherein tabs 30 of anterior layer 28 are of varying height and height of tabs 32 in middle layer 34 are similarly varied. In this embodiment, orientation means is indicated by slit 35. Similar to FIG. IV above, the bottom marginal edge of posterior layer 36 in this embodiment conforms in outline to the tab edges and extends below the ends of tabs 30 and 32. Each of the layers 28, 34 and 36 is of a color or color mixture which is in contrast with the other layers.

FIG. VII represents a third embodiment of the shingle in an assembled state wherein right angled cornered tabs 53 of anterior layer 52 and right angle cornered tabs 54 of middle layer 55 are of the same height but are correspondingly varied in width. In this embodiment, posterior layer 50 is a rectangular sheet, longitudinally coextensive with anterior layer 52, has no indentations on its bottom edge and is positioned to extend below tabs 53 of layer 52 and tabs 54 of middle layer 55 by a margin greater than the slot spaces between tabs 53 and 54. As above, each of layers 50, 52 and 55 has a color value distinguished from the other layers. Orientation means is indicated by tabs 56 extending from the headlap portion of anterior layer 52. This innovation provides added dimensionality to the shingle unit.

FIG. VIII illustrates a fourth embodiment of the shingle in an assembled state wherein all tabs 60 of anterior layer 62 and tabs 64 of middle layer 65 have the same uniform height and width and wherein posterior layer 66 does not extend below the ends of said tabs but is coextensive with the tab bottom edges. In this embodiment, posterior layer 66 may have a contrasting or the same color as the tabs of anterior layer 62 and the color of middle layer 65 and tabs 64 is in contrast with the tabs 60 and posterior layer 66. Orientation means in this embodiment is indicated by embossed markings 68 or indentations in the middle of the spaces between tabs 60 of anterior sheet 62.

FIG. IX is a cross section of each of the shingles illustrated by FIGS. V, VI VII and VIII wherein anterior layer 40 is laminated to middle layer 42 which in turn is laminated to posterior layer 44 and wherein the dotted areas 46 and 48 show the optional width or extension of posterior layer 44 under middle layer 42.

It is shown in assembled FIG. V that the leading end tab of anterior layer 1 and the trailing end tab of middle layer 10 is inset by a margin ½ the width of the spaces between tabs 2 and 12 so that when the next shingle in a row is installed, the uniform border around each tab is maintained. This feature is a preferred embodiment of the invention.

Many additional modifications and variations of the shingles specifically illustrated above will become apparent and these are also included within the scope of this invention.

What is claimed is:

1. A trilaminated roofing shingle comprising:

(a) an anterior layer consisting essentially of a rectangular, granular surfaced shingle sheet having an undivided headlap portion and a butt portion comprising a plurality of tabs of a given breadth separated by spaces approximately 0.50 to 1.25 the breadth of a tab;

(b) a middle layer consisting essentially of a coextensive rectangular, granular surfaced shingle sheet of a width up to about equal the width of the anterior layer, having the same number of tabs of complementary configuration as those of (a) and of a breadth such that the tabs of (b) partially fill the spaces between the tabs of (a), said middle layer being attached to the under surface of said anterior layer in a manner such that the tabs of (b) are centered in and partially fill the spaces between the tabs of (a) and (c) a posterior layer of an undivided, coextensively longitudinal rectangular strip exposable through and filling spaces between said tabs of (a) and (b) and having granules on its surface in at least its exposed areas, said strip having a width greater than the height of the tabs of (b) and being attached to the under surface of (b).

2. The roofing shingle of claim 1 wherein the tabs of said anterior layer are uniformly shaped.

3. The roofing shingle of claim 1 wherein the tabs of said anterior layer are of approximately equal height.

4. The roofing shingle of claim 3 wherein the tabs of said anterior layer have crimped corner edges.

5. The roofing shingle of claim 3 wherein the tabs of said anterior layer have mixed crimped and right angled corner edges.

6. The roofing shingle of claim 1 wherein strip (c) has a color or hue contrasted with the tabs of said middle layer or said anterior layer.

7. The roofing shingle of claim 6 wherein the tabs of said middle layer have a color or hue contrasted with the tabs of said anterior layer or said strip.

8. The roofing shingle of claim 1 wherein each of layers (a), (b) and strip (c) have a different hue or color.

9. The roofing shingle of claim 1 wherein said strip (c) is attached to said headlap portion of middle layer (b).

10. The roofing shingle of claim 1 wherein said strip (c) and said middle layer (b) are of equal width.

11. The roofing shingle of claim 1 wherein the spaces between the tabs of said anterior layer have course orientation means at their top midpoints.

12. The roofing shingle of claim 11 wherein said orientation means is an indentation at the bottom boundary of headlap (a).

13. The roofing shingle of claim 11 wherein said orientation means is an extension from the bottom boundary of headlap (a).

14. The roofing shingle of claim 11 wherein said orientation means is a mark or slot at the bottom boundary of headlap (a).

15. The roofing shingle of claim 1 wherein the bottom boundary of strip (c) has indentations or extensions conforming to the outline of the bottom tab corners of layers (a) and/or (b).

16. The roofing shingle of claim 1 wherein said strip (c) extends below the tabs.

17. The roofing shingle of claim 16 having uniform slots between the tabs of (a) and (b) and wherein said strip (c) extends below the tabs by a margin equal tot he breadth of the slots at the sides of the tabs so as to form a uniform border around each tab.

18. The roofing shingle of claim 1 wherein the tabs of anterior layer (a) are narrower than the tabs of middle layer (b).

19. The roofing shingle of claim 1 wherein the tabs of middle layer (b) are narrower than the tabs of anterior layer (a).

20. The roofing shingle of claim 1 wherein the anterior layer and the middle layer each have 3 to 9 tabs.

21. The roofing shingle of one of claims 1, 6, 7 or 8 wherein said tabs of (b) are mirror images of the tabs of (a), each tab has two opposing corners one pair of successive tabs has facing right angled corners and outer crimped corners and said pair is adjacent to a tab having both corners crimped.

22. The roofing shingle of claim 1 wherein the width of strip (c) is equal to the width of anterior layer (a).

23. The roofing shingle of claim 1 wherein the slots between tabs (a) and (b) are uniform.

24. The roofing shingle of claim 1 wherein the tabs of (a) and/or the tabs of (b) are of unequal breadth to form slots of similarly unequal breadth.

25. The roofing shingle of claim 1 wherein the tabs of (a) are of different heights.

26. The roofing shingle of one of claims 24 and 25 wherein strip (c) extends below middle layer (b) and forms a border of contrasting hue or color around each tab.

27. The roofing shingle of claim 1 wherein the tabs of (a) and (b) are of uniform height and the bottom boundary of strip (c) is coextensive with the bottom boundary of (b).

28. The roofing shingle of one of claims 1, 6, 7 or 8 wherein said tabs of (b) are mirror images of the tabs of (a), each tab has two opposing corners one pair of successive tabs has facing right angled corners and outer crimped corners and said pair is adjacent to a tab having both corners crimped, strip (c) extends below the tabs of (a) and (b) and the bottom edge of strip (c) carries indentations which correspond in outline to follow the contour of the crimped corners of the tabs.

* * * * *